US008360549B2

(12) United States Patent
Choi

(10) Patent No.: US 8,360,549 B2
(45) Date of Patent: Jan. 29, 2013

(54) INKJET IMAGE FORMING APPARATUS AND SPITTING METHOD THEREFOR

(75) Inventor: Hyoung-dong Choi, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 687 days.

(21) Appl. No.: 12/039,850

(22) Filed: Feb. 29, 2008

(65) Prior Publication Data

US 2009/0002413 A1 Jan. 1, 2009

(30) Foreign Application Priority Data

Jun. 28, 2007 (KR) ..... 10-2007-0064615

(51) Int. Cl.
*B41J 2/165* (2006.01)

(52) U.S. Cl. ..... 347/35

(58) Field of Classification Search ..... 347/35
See application file for complete search history.

(56) References Cited

U.S. PATENT DOCUMENTS

| | | | | |
|---|---|---|---|---|
| 5,574,485 | A * | 11/1996 | Anderson et al. | 347/27 |
| 6,241,337 | B1 * | 6/2001 | Sharma et al. | 347/33 |
| 7,731,329 | B2 * | 6/2010 | Yearout et al. | 347/36 |
| 2003/0076375 | A1 * | 4/2003 | Harriman et al. | 347/19 |
| 2006/0066697 | A1 * | 3/2006 | Inoue | 347/89 |
| 2007/0046757 | A1 * | 3/2007 | Kim | 347/104 |
| 2007/0188542 | A1 * | 8/2007 | Kanfoush et al. | 347/21 |

* cited by examiner

*Primary Examiner* — Uyen Chau N Le
*Assistant Examiner* — Hoang Tran
(74) *Attorney, Agent, or Firm* — Staas & Halsey LLP

(57) ABSTRACT

An inkjet image forming apparatus and a spitting method therefor. The inkjet image forming apparatus includes: a printhead including a plurality of nozzles arranged across a printing medium transfer path; a maintenance unit including a spitting groove to receive ink ejected during a spitting operation of the printhead; and a controlling unit to control the printhead so that spitting is performed by groups of the nozzles, when each group faces the spitting groove.

8 Claims, 6 Drawing Sheets

INKJET IMAGE FORMING APPARATUS AND SPITTING METHOD THEREFOR

CROSS-REFERENCE TO RELATED APPLICATION

This application claims the benefit of Korean Application No. 2007-64615, filed Jun. 28, 2007, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to a inkjet image forming apparatus including a printhead having a length corresponding to the width of a printing medium, and a spitting method for the inkjet image forming apparatus.

2. Description of the Related Art

An inkjet image forming apparatus ejects ink onto a printing medium, to form an image. Inkjet image forming apparatuses are classified into shuttle-type inkjet image forming apparatuses, and line-type inkjet image forming apparatuses, according to the printing method. The shuttle-type inkjet image forming apparatus prints an image using a printhead that is shuttled in a direction perpendicular to a transfer path of a printing medium. The line-type inkjet image forming apparatus prints an image using a printhead that includes a nozzle unit having nozzles arranged across a transfer path of a printing medium.

Generally, in a printhead, a thermal element or a piezoelectric element is used to eject ink. High resolution print heads are manufactured using a semiconductor manufacturing process (e.g., etching, deposition or sputtering). In printheads, ink is ejected from a nozzle unit formed in the printhead, onto a printing medium, to form an image. Over time, ink can build up on a surface of the nozzle unit and/or in nozzles of the nozzle unit, interfering with the ejection of ink droplets, thereby reducing printing quality. In order to prevent such problems, a maintenance operation is performed to clean the nozzle unit. The maintenance operation includes wiping and spitting operations, or the like. The wiping involves wiping away residual ink left on the nozzle unit. The spitting involves the ejection of ink, after a printing operation has been performed. In addition, to effectively remove residual ink left in/on the nozzles, nozzles are cleaned with a cleaning solution, using ultrasonic waves.

The printhead of the line-type inkjet image forming apparatus includes a nozzle unit to eject ink, having a length corresponding to the width of a printing medium. When the nozzle unit is wiped, ink wiped from a nozzle row may contaminate other nozzle rows. That is, since the printhead, of the line-type inkjet image forming apparatus, has a long length, waste ink wiped from one nozzle row may contaminate other adjacent nozzle rows.

SUMMARY OF THE INVENTION

Aspects of the present invention provide an inkjet image forming apparatus, and a spitting method therefor. In the spitting method, ink that is wiped from a nozzle row can be effectively prevented from contaminating other nozzle rows.

According to an aspect of the present invention, there is provided an inkjet image forming apparatus including: a printhead having a plurality of nozzles disposed across a printing medium transfer path; a maintenance unit having a spitting grove to receive ink ejected during a spitting operation of the printhead; and a controlling unit to control the printhead, such that the spitting is performed by groups of nozzles, which face the spitting groove.

According to aspects of the present invention, the apparatus may further comprise a driving motor to move the maintenance unit. The controlling unit determines the relative locations of the groups of nozzles, with respect to the spitting groove, using a rotational position of the driving motor.

According to aspects of the present invention, the printhead may perform the spitting with respect to a groups of nozzles determined to face the spitting groove.

According to aspects of the present invention, the controlling unit may control the printhead, such that the spitting is performed in response to an interrupt signal generated by the driving motor.

According to aspects of the present invention, the maintenance unit may be moved in a horizontal scanning direction (across a printing medium transfer path).

According to aspects of the present invention, the maintenance unit may further include a wave generating element to generate ultrasonic waves, such that a cleaning solution contacts and cleans the nozzles. The maintenance unit may further include a wiper to wipe the nozzles, after the cleaning solution is applied to the nozzles.

According to another aspect of the present invention, there is provided a spitting method for a printhead, in which a plurality of nozzles are arranged across a printing medium transfer path, the method comprising: moving a spitting groove to receive ink ejected during a spitting operation of the printhead; and performing the spitting using nozzle groups, when each of the nozzle groups faces the spitting groove.

According to aspects of the present invention, the spitting groove is moved using a driving motor, and the spitting operation comprises determining the relative locations of groups of the nozzles, with respect to the spitting groove, using a rotational position of the driving motor.

According to aspects of the present invention, the spitting operation may further include spitting ink from the group of nozzles determined to face the spitting groove.

According to aspects of the present invention, the spitting operation may be performed in response to an interrupt signal generated by the driving motor.

According to aspects of the present invention, the spitting groove may be moved in a horizontal scanning direction (across a printing medium transfer path).

According to aspects of the present invention, the method may further include using ultrasonic waves to apply the cleaning solution to the nozzles. The cleaning solution may be wiped from the nozzles when the spitting groove is moved.

Additional aspects and/or advantages of the invention will be set forth in part in the description which follows and, in part, will be obvious from the,description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, of which.

DETAILED DESCRIPTION OF THE EXEMPLARY EMBODIMENTS

Figure 1:
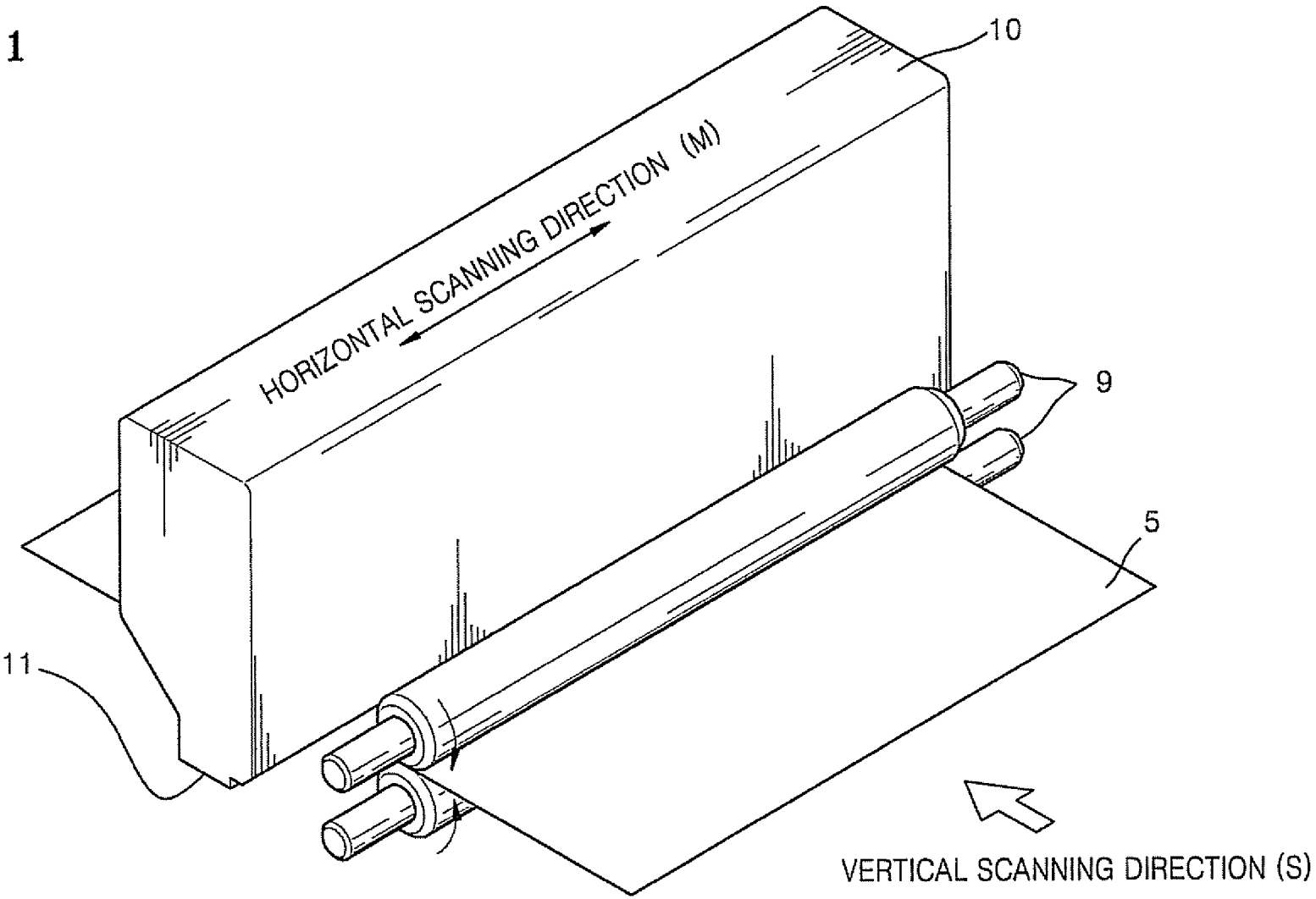
FIG. 1 is a perspective view of an inkjet image forming apparatus, according to an exemplary embodiment of the present invention.

Reference will now be made in detail to the exemplary embodiments of the present invention, which are illustrated in the accompanying drawings, wherein like reference numerals refer to the like elements throughout. The exemplary embodiments are described below, in order to explain the aspects of present invention, by referring to the figures.

FIG. 1 is a perspective view of an inkjet image forming apparatus, according to an embodiment of the present invention. Referring to FIG. 1, a printing medium 5 is transferred in a vertical scanning direction S, along a printing medium transfer path, by a transfer unit 9 that includes a pair of rollers that are rotatably engaged with each other. A printhead 10 is installed above the printing medium 5. The printhead 10 prints an image on the printing medium 5, by ejecting ink onto the printing medium 5, at fixed positions. The printhead 10 is an array-type printhead including a nozzle unit 11, having a length corresponding to the horizontal scanning direction M, and which is equal to the width of the printing medium 5.

Figure 2:
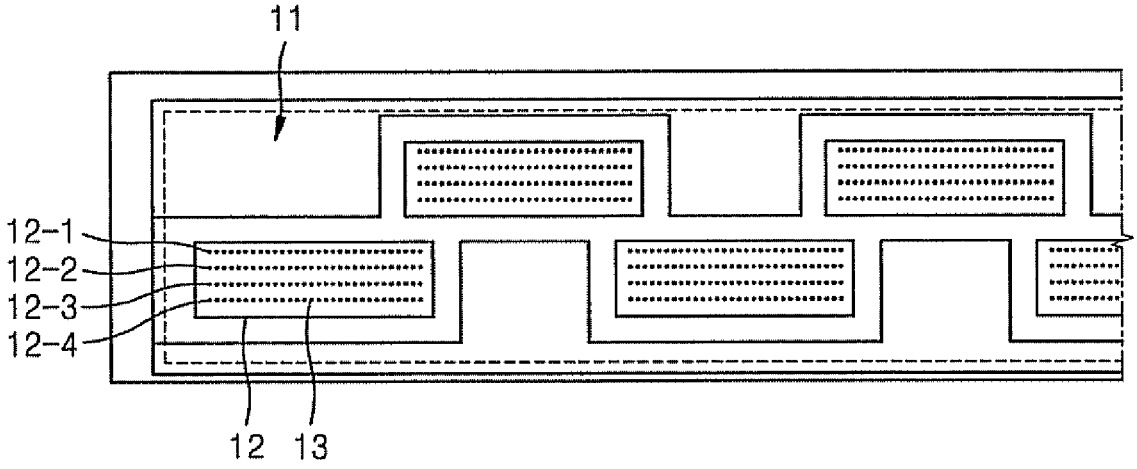
FIG. 2 is a view of a nozzle unit illustrated in FIG. 1, according to an exemplary embodiment of the present invention.

FIG. 2 is a view of the nozzle unit 11 illustrated in FIG. 1, according to an exemplary embodiment of the present invention. Referring to FIG. 2, the nozzle unit 11 includes a plurality of nozzle chips 12 arranged in a horizontal scanning direction (across the printing medium transfer path). A plurality of nozzles 13 to eject ink, are formed in each of the nozzle chips 12. A plurality of nozzle rows 12-1, 12-2, 12-3, and 12-4 may be formed in the nozzle chips 12. The nozzle rows 12-1, 12-2, 12-3, and 12-4 can eject the same ink, or can eject ink of different colors (e.g., magenta, yellow, cyan, and black). FIG. 2 illustrates an exemplary embodiment of the nozzle unit 11, but the present invention is not limited thereto.

Although not illustrated, the printhead 10 may include a chamber having an ejector (e.g., a piezoelectric element or a heater) formed therein, which provides pressure to eject ink, and a flow channel to provide ink to the chamber. Since the chamber, the ejector, and the flow channel are well known to one of ordinary skill in the art, detailed descriptions thereof are be omitted.

When the nozzle unit 11 is exposed to the outside air, ink droplets surrounding the nozzle unit 11 may solidify (forming residual ink), and foreign substances (e.g., minute particles of dust) from the outside air may attach to the nozzle unit 11. The residual ink and/or the foreign substances may interfere with ink ejection (distort the ejection direction), and thus, degrade printing quality. The nozzle unit 11 can become clogged, due to a buildup of the residual ink on the nozzle unit 11. Since the printhead 10 prints an image at a fixed position, when some of the nozzles 13 are clogged, white lines are formed on a printed image. To prevent this printing error, a maintenance unit is used to remove the residual ink and/or foreign substances attached to the nozzle unit 11.

Figure 3:
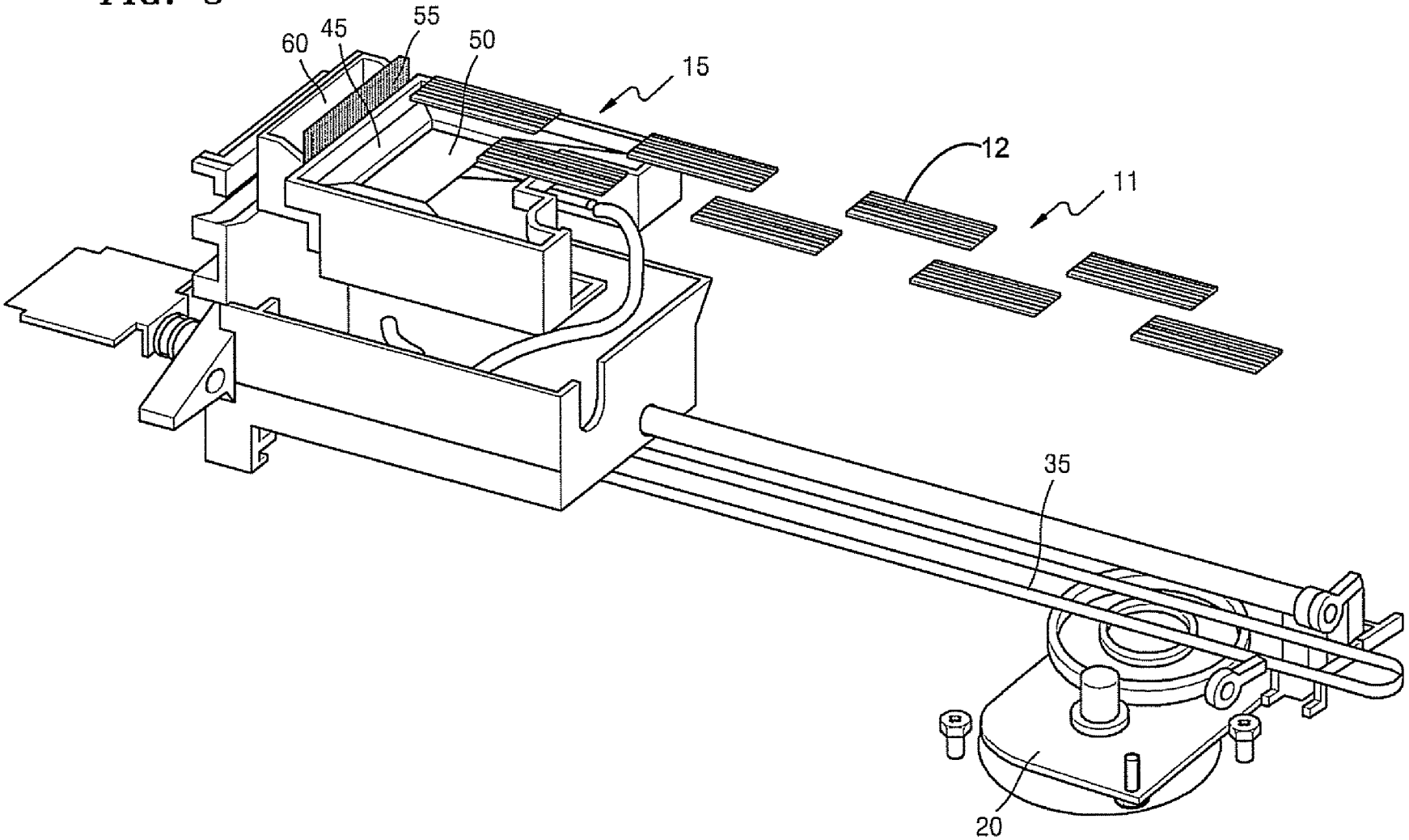
FIG. 3 is a perspective view of an inkjet image forming apparatus including a maintenance unit, according to another exemplary embodiment of the present invention.
Figure 4:
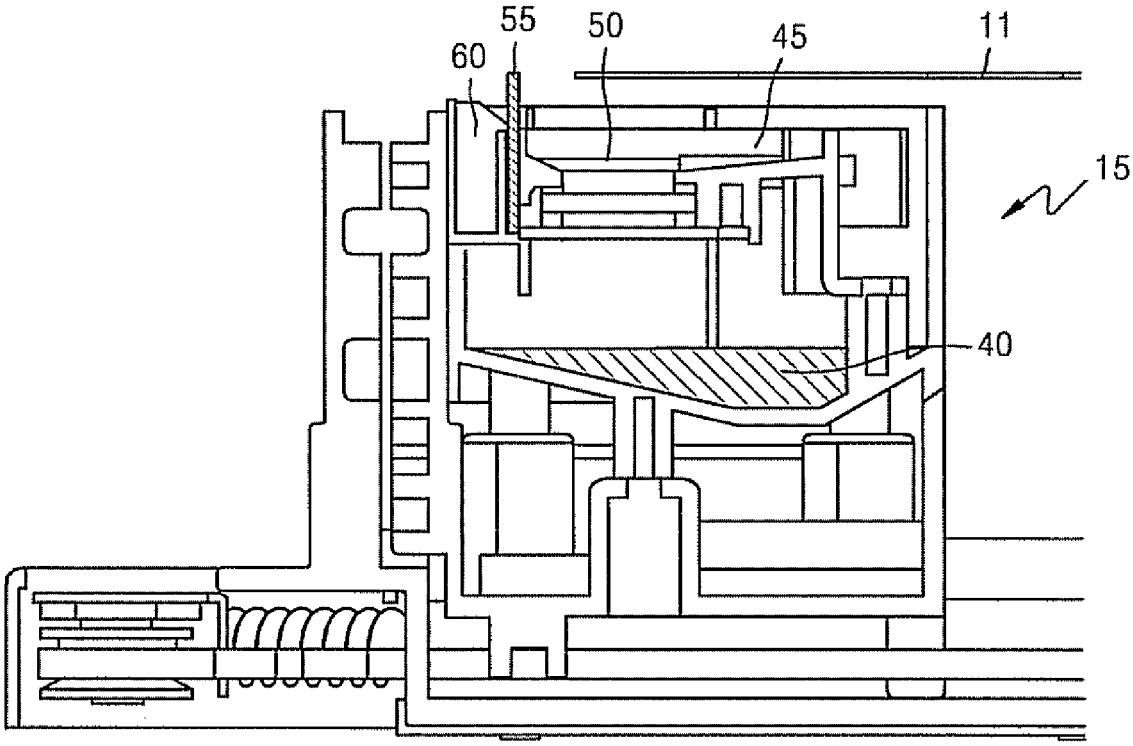
FIG. 4 is a side view of the maintenance unit illustrated in FIG. 3, according to an exemplary embodiment of the present invention.

FIG. 3 is a perspective view of an inkjet image forming apparatus, including a maintenance unit 15, according to another exemplary embodiment of the present invention. FIG. 4 is a side view of the maintenance unit 15 illustrated in FIG. 3, according to an exemplary embodiment of the present invention. The inkjet image forming apparatus of FIG. 3 includes the printhead 10 illustrated in FIG. 1. In FIGS. 3 and 4, only a nozzle unit 11 of the printhead 10 is illustrated, for convenience of the description.

Referring to FIG. 3, the inkjet image forming apparatus includes the maintenance unit 15, a driving motor 20 to drive the maintenance unit 15 in a horizontal scanning direction. The maintenance unit 15 is coupled by a belt 35 to the driving motor 20, such that the driving motor 20 moves the maintenance unit 15 in the horizontal scanning direction.

Referring to FIGS. 3 and 4, the maintenance unit 15 is to clean the nozzles of the printhead 10, using ultrasonic waves. The maintenance unit 15 includes a storage tank 40, a cleaning tank 45, and a wave generating element 50. A cleaning solution to clean the nozzles is stored in the storage tank 40. For example, the cleaning solution may be water, a detergent, a solvent, or a combination thereof. A top surface of the cleaning tank 45 is open, so that the cleaning solution in the storage tank 40 may face the nozzle unit 11 of the printhead 10, at predetermined intervals. The wave generating element 50 is installed in the cleaning tank 45. The wave generating element 50 generates ultrasonic waves in the cleaning solution in the cleaning tank 45, to apply the cleaning solution to the nozzles.

The maintenance unit 15 includes a wiper 55 that wipes the nozzles, after the application of the cleaning solution to the nozzles. The wiper 55 wipes the nozzles, according the movement of the maintenance unit 15. An elastic rubber blade may be used as the wiper 55. The maintenance unit 15 may include a spitting groove 60 to receive ink droplets ejected during a spitting operation of the printhead 10. The image forming apparatus also includes a controller (not shown) to control the printhead 10, such that the spitting is performed by nozzles that face the spitting groove 60, according to the movement of the maintenance unit 15. The controller will be described with reference to FIG. 5.

Figure 5:
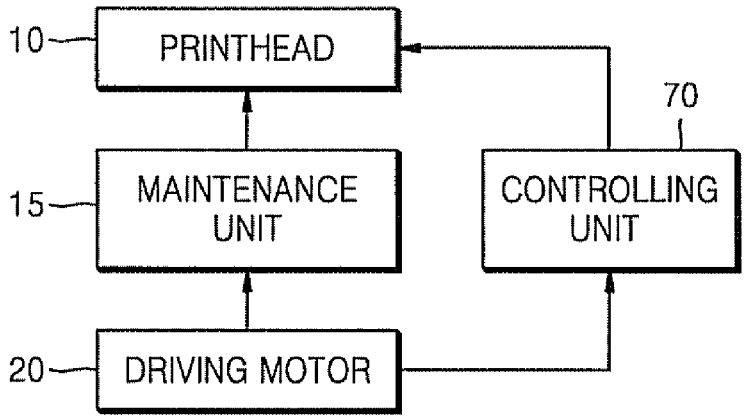
FIG. 5 is a block diagram of the inkjet image forming apparatus including the maintenance unit illustrated in FIG. 3, according to another exemplary embodiment of the present invention.
Figure 6:
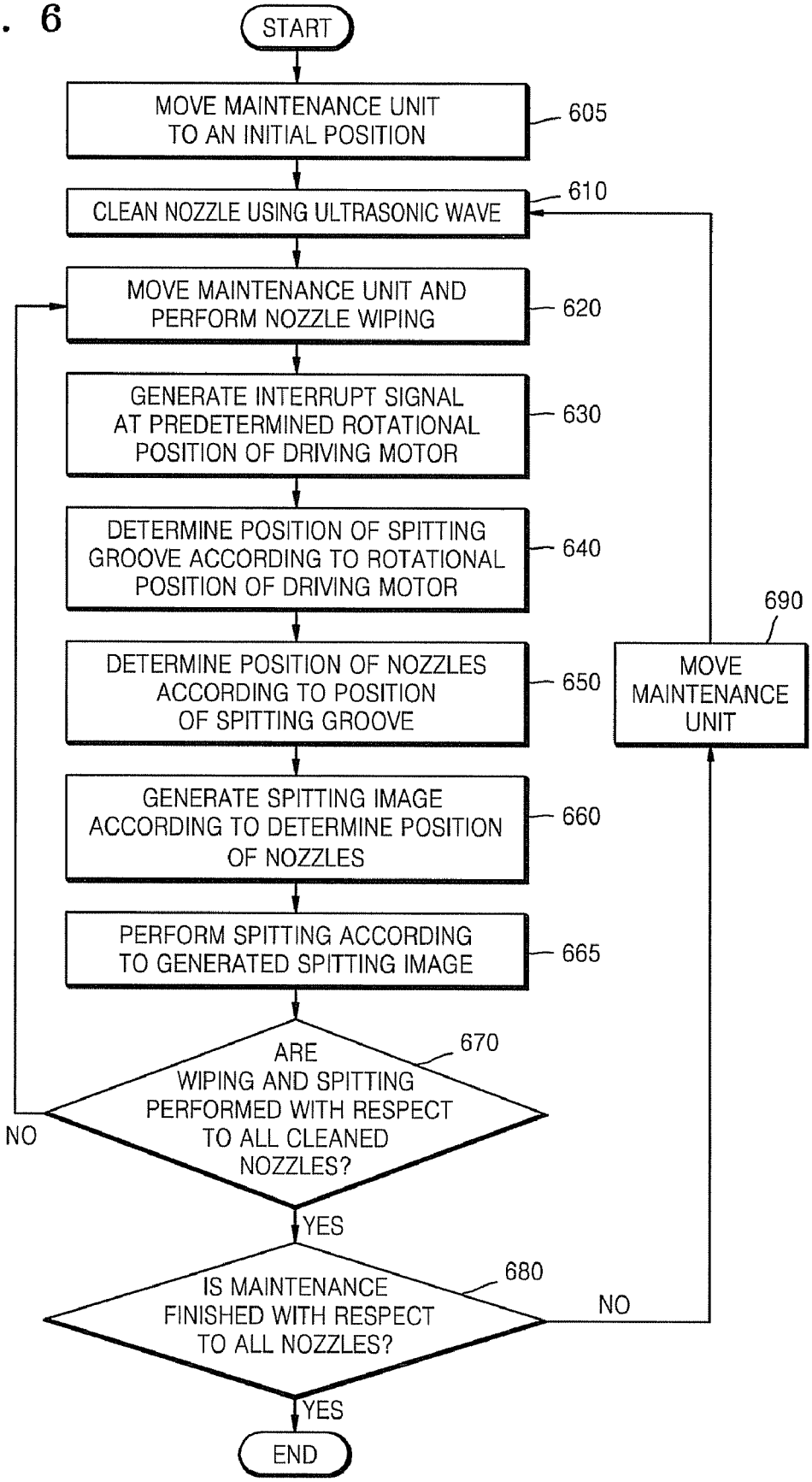
FIG. 6 is a flow chart of a spitting method for cleaning a printhead, according to an exemplary embodiment of the present invention.

FIG. 5 is a block diagram of the inkjet image forming apparatus illustrated in FIG. 3, according to another exemplary embodiment of the present invention. The inkjet image forming apparatus includes a printhead 10, a maintenance unit 15, a driving motor 20, and a controlling unit 70 to control spitting of the printhead 10. FIG. 6 is a flow chart of a spitting method performed by a printhead, according to an exemplary embodiment of the present invention. Operations of the inkjet image forming apparatus will be described with reference to FIG. 6.

In operation 605, the maintenance unit 15 is moved to an initial position, for example, to a leftmost position in FIG. 3, by the driving motor 20, to clean the printhead 10.

In operation 610, a wave generating element 50 of the maintenance unit 15 generates ultrasonic waves, such that the cleaning solution in a cleaning tank 45 is applied to nozzles disposed above the cleaning tank 45.

In operation 620, when the maintenance unit 15 is moved by the driving motor 20 and the nozzles contact the wiper 55. The wiper 55 removes the cleaning solution from the nozzles.

In operation 630, the driving motor 20 generates an interrupt signal, when the driving motor 20 arrives at a predetermined rotational position. The interrupt signal is transferred to the controlling unit 70.

In operation 640, the controlling unit 70 determines the position of the spitting groove 60, according to the rotational position of the driving motor 20, in response to the interrupt signal. Alternatively, the position of the spitting groove 60 may be stored beforehand in a memory (now shown), which can be part of the controlling unit 70, or can be a separate unit.

In operation 650, the controlling unit 70 determines which of the nozzles are facing the spitting groove 60, using the position of the spitting groove 60 determined in operation 640. Alternatively, the positions of the spitting groove 60 can be correlated with nozzles facing the spitting groove 60, and may be stored in the memory. For example, the positions of the spitting groove can correspond to particular nozzle chips, and/or the locations of nozzles on the nozzle chips.

In operation 660, the controlling unit 70 generates a signal corresponding to a spitting image, which corresponds to the nozzle determinations made in the operation 650. The spitting image is a spitting pattern, which corresponds to a spitting pattern made by the nozzles during spitting.

In operation 665 of FIG. 6, when the controlling unit 70 transfers the generated signal to the printhead 10, the printhead 10 performs spitting, according to the spitting image. Accordingly, spitting is performed by the nozzles (i.e., groups of the nozzles) determined in operation 650 to be facing the spitting groove 60. At this time, the printhead 10 may perform spitting using four inks, such as, cyan, magenta, yellow, and black inks. Alternatively, spitting may be performed with any of the four inks. In addition, the printhead 10 may perform spitting, such that the different inks are spit out in the arrangement order of the four inks, or alternatively, in a predetermined arrangement order.

Figure 7:
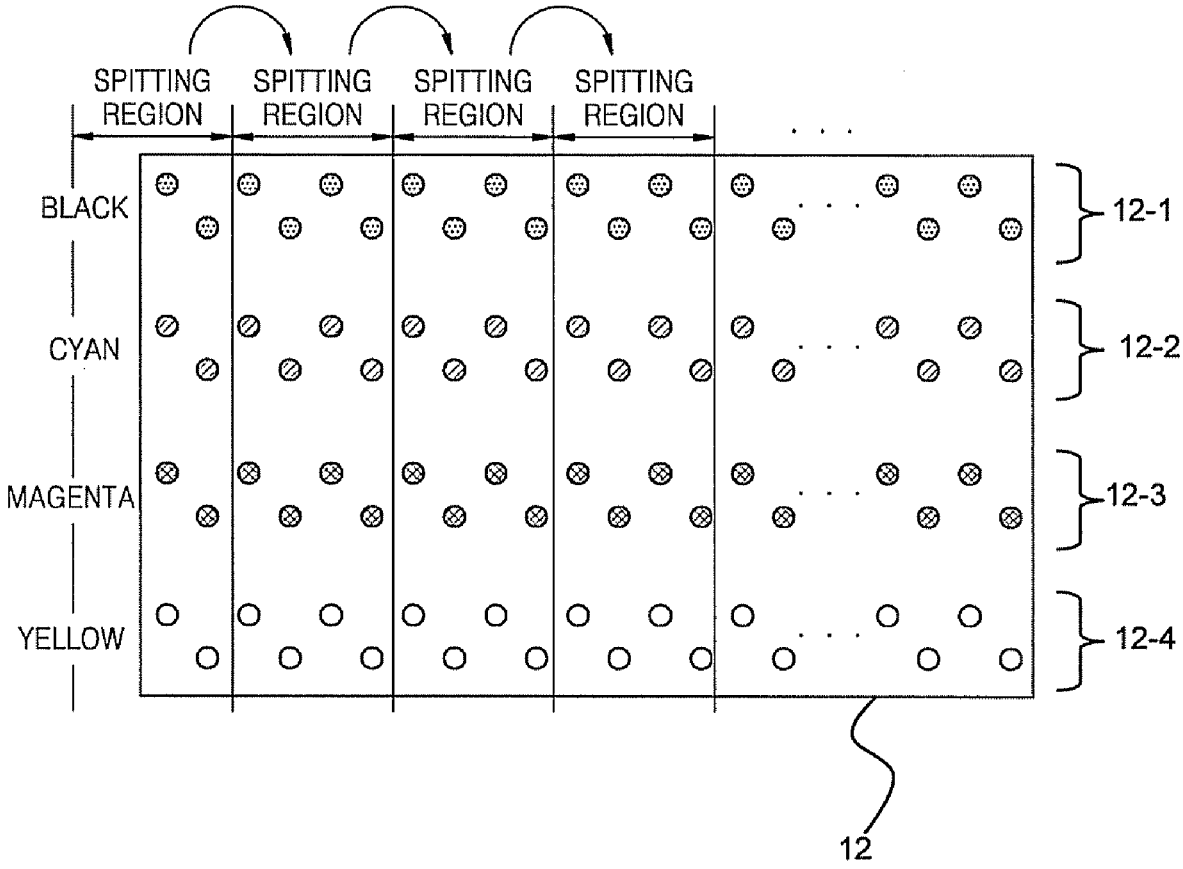
FIG. 7 is a view of a nozzle chip of a printhead, for further explaining the spitting method of FIG. 6, according an exemplary embodiment of the present invention.

FIG. 7 is a view of a nozzle chip 12 of the printhead 10, for illustrating the spitting performed in operations 620 through 665, according an exemplary embodiment of the present invention. As described in FIG. 7, the nozzle chip 12 may include nozzle rows 12-1, 12-2, 12-3, and 12-4 to eject cyan, magenta, yellow, and black ink, respectively. According to the movement of the maintenance unit 15 in the operation 620, the spitting groove 60 may be moved along the nozzle rows 12-1, 12-2, 12-3, and 12-4. Nozzles (groups of nozzles) in a spitting region (a region where the nozzles face the spitting groove 60), eject ink into the spitting groove 60. The spitting region is successively moved, according to the movement of the spitting groove 60, as illustrated in FIG. 7. Accordingly, when the spitting groove 60 is moved, the nozzles (groups) disposed in the spitting region are wiped, and then perform the spitting.

Conventionally, when nozzle rows ejecting ink of different colors are wiped, residual ink, which is removed from a nozzle row, may contaminate other nozzle rows (i.e., a color mixing phenomenon occurs). The color mixing phenomenon can be prevented by performing spitting. The larger the ink drops ejected during spitting, and the more quickly the spitting is performed, the more effectively the color mixing phenomenon can be prevented. Increasing the amount of ink ejected during spitting decreases the amount of ink which can be used in a printing operation, and the inner parts of the inkjet image forming apparatus can be contaminated due to ink ejection. Accordingly, it is beneficial to quickly perform the spitting after the wiping. Since only nozzles facing a spitting groove perform the spitting, while the spitting groove is moving, the spitting occurs very soon after the wiping. Thus, a relatively small amount of ink is ejected, thereby preventing the occurrence of the color mixing phenomenon.

In operation 670, if all of the cleaned nozzles have been wiped and spit, the method proceeds to operation 680. If not, the method returns to operation 620, in order to wipe and spit the remaining cleaned nozzles. Whether all the cleaned nozzles have been wiped and spit can be determined, since the number of times the wiping and spitting are performed, per one cleaning operation 610, is stored in the memory.

In operation 680, if the operations 610 through 665 are finished, with respect to all the nozzles of the printhead 10, the spitting is terminated. Otherwise, the method proceeds to operation 690. In operation 690, the maintenance unit 15 is moved, so that the above operations may be performed with respect to all the nozzles for which the operations 610 through 665 have not been performed. In other words, the method is performed until the nozzles of all the nozzle chips are cleaned, wiped, and spit.

Various exemplary embodiments of the present invention can be written as computer programs stored on a computer readable recording medium, and can be implemented in general-use digital computers/processors. In addition, the structure of the data used in the exemplary embodiments of the present invention, can be recorded by various methods in the computer recordable medium. Examples of the computer readable recording medium include magnetic storage media (e.g., ROM, floppy disks, hard disks, etc.), optical recording media (e.g., CD-ROMs, or DVDs), and storage media such as carrier waves (e.g., transmission through the Internet).

According to aspects of the present invention, spitting can be quickly performed after wiping, and waste ink removed from a nozzle row during the wiping can be prevented from contaminating other nozzle rows.

Although a few exemplary embodiments of the present invention have been shown and described, it would be appreciated by those skilled in the art that changes may be made in these exemplary embodiments, without departing from the principles and spirit of the invention, the scope of which is defined in the claims and their equivalents.

What is claimed is:

1. A spitting method for a printhead comprising a plurality of nozzles arranged across a transfer path of a printing medium, the method comprising:

moving a maintenance unit, including a cleaning tank and a spitting groove, and applying a cleaning solution to nozzles facing an open top surface of the cleaning tank from among the plurality of nozzles;

moving the maintenance unit and wiping the cleaned nozzles according to the movement of the maintenance unit;

moving the maintenance unit by rotating a part of a driving motor such that the spitting groove is positioned to receive ink spit from the wiped nozzles among the plurality of nozzles;

generating an interrupt signal by the motor driving the maintenance unit, thereby only the wiped nozzles from among the plurality of nozzles are facing the spitting groove;

determining a position of the spitting groove based on a rotational position of the rotating part of the motor in response to the generated interrupt signal;

determining a group of the wiped nozzles facing the spitting groove from among the plurality of nozzles based on the determined position of the spitting groove; and spitting by only the group of the wiped nozzles determined to be facing the spitting groove from among the plurality of nozzles;

determining whether all of the cleaned nozzles have been wiped and spit; and moving the maintenance unit such that the spitting groove is positioned to receive ink spit from another of the group determined from among the plurality of nozzles, upon determining that all of the cleaned nozzles have not been wiped and spit, wherein the plurality of nozzles performs the spitting in sequence of the wiping has been performed.

2. The method of claim 1, wherein the spitting groove is moved across the transfer path.

3. The method of claim 1, wherein the cleaning solution is applied to the nozzles using ultrasonic waves.

4. The method of claim 3, wherein the moving of the spitting groove comprises using a wiper to wipe the cleaning solution from the printhead.

5. The method of claim 1, wherein the ink comprises cyan, magenta, yellow, and black inks.

6. The method of claim 5, wherein the performing of the spitting comprises ejecting each of the cyan, magenta, yellow, and black inks in a particular order.

7. A spitting method for a printhead comprising a plurality of nozzles arranged across a transfer path of a printing medium, the method comprising:

applying a cleaning solution to nozzles facinq an open top surface of a cleaning tank from among the plurality of nozzles;

moving a maintenance unit comprising a spitting groove and a wiper, across the transfer path by rotating a part of a driving motor, such that the wiper contacts groups of the plurality of nozzles before each group faces the spitting groove;

detecting when each group faces the spitting groove based on a rotational position of the rotating part of the motor; and spitting the ink from each group, when each group is determined to face the spitting groove, wherein the each group performs the spitting in sequence of the wiping has been performed.

8. The method of claim 7, further comprising moving the maintenance unit such that the spitting groove is positioned to receive ink spit from a group of the nozzles, upon determining that that not all of the groups of cleaned nozzles have been wiped and spit.

* * * * *

UNITED STATES PATENT AND TRADEMARK OFFICE

CERTIFICATE OF CORRECTION

PATENT NO. : 8,360,549 B2
APPLICATION NO. : 12/039850
DATED : January 29, 2013
INVENTOR(S) : Hyoung-dong Choi It is certified that error appears in the above-identified patent and that said Letters Patent is hereby corrected as shown below:

In the Claims:

Column 8, Line 1, In Claim 7, delete “facinq” and insert -- facing --, therefor.
Column 8, Line 19, In Claim 8, before “not” delete “that”.

Signed and Sealed this
Twenty-eighth Day of May, 2013

Teresa Stanek Rea
*Acting Director of the United States Patent and Trademark Office*